United States Patent [19]

Cabrelli

[11] Patent Number: 4,615,278

[45] Date of Patent: Oct. 7, 1986

[54] SHELVING APPARATUS AND METHOD OF ASSEMBLING SAME

[76] Inventor: Peter A. Cabrelli, 1284 Ragley Hall Rd., Atlanta, Ga. 30319

[21] Appl. No.: 686,100

[22] Filed: Dec. 24, 1984

[51] Int. Cl.[4] ..... A47B 93/00

[52] U.S. Cl. ..... 108/111; 248/188; 108/144

[58] Field of Search ..... 108/111, 144, 148, 149, 108/153, 156, 108; 248/231.8, 180, 228.1, 188.1, 246, 219.1; 403/399, 398, 397, 346, 347; 211/182, 186, 187

[56] References Cited

U.S. PATENT DOCUMENTS

| | | | |
|---|---|---|---|
| D. 215,773 | 10/1969 | Maslow | 80/10 |
| D. 234,908 | 4/1975 | Maslow | 8/236 |
| D. 241,297 | 9/1976 | Maslow | 6/191 |
| 1,011,161 | 12/1911 | Comstock . | |
| 3,424,111 | 1/1969 | Maslow | 108/144 |
| 3,523,508 | 8/1970 | Maslow | 108/144 |
| 3,757,705 | 9/1973 | Maslow | 108/144 |
| 3,851,601 | 12/1974 | Davis | 108/153 |
| 3,874,511 | 4/1975 | Maslow | 211/153 |
| 3,883,104 | 5/1975 | Delafield | 248/188 |
| 3,912,410 | 10/1975 | Pofferi | 403/170 |
| 3,915,101 | 10/1975 | Onori | 108/111 |
| 3,927,769 | 12/1975 | Maslow | 211/153 |
| 4,057,356 | 11/1977 | Nissen | 248/188 X |
| 4,094,417 | 6/1978 | Cairnes et al. | 211/183 |
| 4,138,953 | 2/1979 | Tashman | 248/188 X |
| 4,230,052 | 10/1980 | Champagne | 108/144 |
| 4,237,798 | 12/1980 | Welsch et al. | 108/111 |
| 4,318,352 | 3/1982 | Friedman et al. | 108/111 |

FOREIGN PATENT DOCUMENTS

| | | | |
|---|---|---|---|
| 1030905 | 5/1978 | Canada | 211/38 |
| 558349 | 5/1923 | France | 248/188 |
| 413269 | 12/1966 | Switzerland | 248/188 |

*Primary Examiner*—Peter A. Aschenbrenner
*Attorney, Agent, or Firm*—Thomas & Kennedy

[57] ABSTRACT

Shelving apparatus comprises a post (10), a collar (14) configured to be placed flushly against one side of the post (10) with two collar guide bars (15) extending outwardly from the opposite sides thereof, and detent means (12/18) or fixedly locating the collar axially along the post (10). The apparatus also includes a support (20) having a recess (25) configured to be placed flushly against another side of the post. The support recess is formed with two slots (27) configured to receive and to wedge into gripping engagement the two collar guide bars for drawings the collar and support tightly about the post.

7 Claims, 5 Drawing Figures

SHELVING APPARATUS AND METHOD OF ASSEMBLING SAME

TECHNICAL FIELD

This invention relates to shelving and to methods of assembling shelving. More specifically, the invention relates to an adjustable shelving system in which additional shelves can be added between the already assembled shelves of a structure.

BACKGROUND OF THE INVENTION

Shelving systems often are designed to be adjustable so as to permit relocation of shelves upon a support frame composed of upright support members. Also, some shelving systems are designed so that the number of shelves can be altered by adding more shelves to or removing shelves from a support frame. This provides versatility to a shelving system and the potential for future expansion of the shelving to provide increased storage capacity as the need arises.

Examples of prior art adjustable shelving systems are disclosed in U.S. Pat. Nos. 3,424,111, 3,523,508, 3,757,705, 3,874,511 and 3,927,769. Some of the prior art adjustable shelving systems comprise upright post members having horizontal grooves and horizontal shelves connected to the grooves of the posts. Each shelf typically has an annular or conical collar formed on each of its corners which are slid down over the end of the posts to a desired height located over a groove in each post. The collars are provided with various mechanisms for bringing them into gripping engagement with the posts with a collar component engaging the selected post groove. Similar constructions to that just described are shown in U.S. Pat. Nos. 3,851,601, 3,912,410, 4,094,417, 4,318,352 and in Design U.S. Pat. Nos. Des. 215,773, Des. 234,906 and Des. 271,297.

Though the just described adjustable shelving systems are versatile, most have one common trait that has provided a distinctly limiting factor. The shelves, or horizontal shelf support elements, have had to be sequentially slid along the upright shelf supporting posts when the shelving is being assembled or when an additional shelf is to be added to or removed from a preassembled shelving structure. Thus, another shelf could not be added to the post framework between previously assembled shelves. Therefore, where it has been desirable to add a shelf to the frame of a previously assembled shelving structure the additional shelf has had to be mounted as the upper-most shelf member in the system unless the previously assembled shelves were removed and relocated. Occasionally this has been impractical where the tops of the post were blocked.

Accordingly, if a practical, versatile and inexpensive shelving system could be devised that overcomes the just described limitations, a distinct advance in the art would be achieved. It is the provision of shelving system and a method of assembling shelving which overcomes these limitations to which the present invention is primarily directed.

SUMMARY OF THE INVENTION

Briefly described the present invention comprises a shelving system which includes upright cylindrical support posts having indentations formed in their exterior surfaces at spaced intervals along the length of each post. Collars of generally semicylindrical shape are provided, each having flanges formed along radially opposed side edges thereof and a protrusion formed on its interior surface for detenting engagement with an indentation of a post, with each collar mounted about one side of the post. A corner support also is provided for each corner of a shelf, with each corner support having a semicylindrical recess formed in a side thereof for partially surrounding a post and a pair of slots formed along radially opposed portions of the interior surface of the recess which are configured to receive and wedge into gripping engagement with the pair of collar flanges as the recess of the corner support is slid along the opposite side of the post and into engagement with the flanges of the collar.

The invention includes a method of assembling shelving and comprises the steps of placing a collar having an inwardly projecting protrusion against one side of an upright post with the collar protrusion detented within a post recess, placing a support against an opposite side of the post above the collar, and sliding the support downwardly so as to wedge two collar elements that project outwardly from the posts into two slots that are formed in the support and thereby cause the collar and the support to grip the post securely.

Therefore, it is an object of this invention to provide an improved shelving system which is inexpensive to construct, easy to assemble, and which permits adding a shelf between previously assembled shelves.

Another object of this invention is to provide a shelving system and a method of assembling a shelving system which forms a sturdy assembly that can have shelves added between or removed from between other shelves without dissassembling the other shelves and supports.

Other objects, features and advantages of this invention will become obvious when reading the following specification when taken in conjunction with the accompanying drawings.

DETAILED DESCRIPTION

Figure 1:
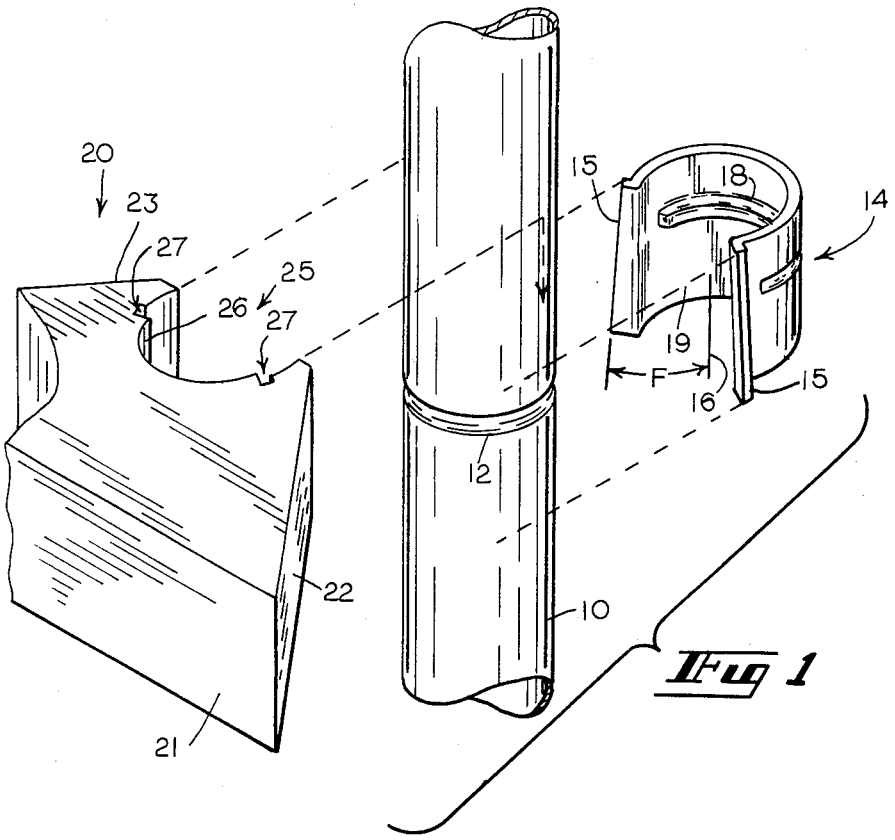
FIG. 1 is an exploded detail perspective view of shelving apparatus embodying principles of the present invention.
Figure 2:
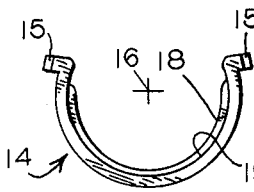
FIG. 2 is a plan view of the collar element of the apparatus shown in FIG. 2.
Figure 3:
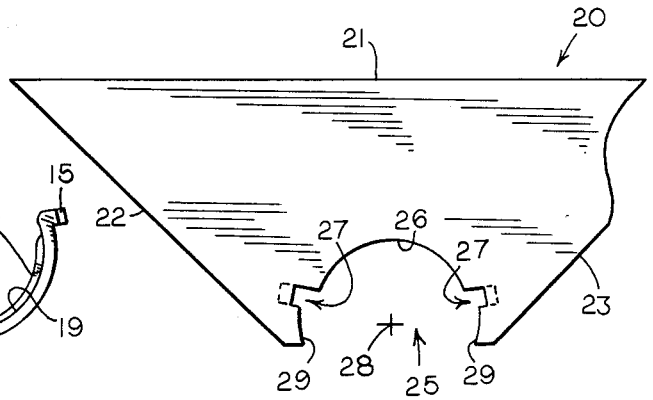
FIG. 3 is a plan view of the shelf support element of the apparatus shown in FIG. 1.

With reference next to the drawings, FIG. 1 shows shelving apparatus 9 which includes a plurality of upright, cylindrical posts 10 having annular indentations or grooves 12 formed in the exterior surface thereof. A lock collar 14 is provided of a generally semicylindrical configuration which has two flanges 15 that function as guide bars which flare radially outwardly from the collar axis 16. Each flange is tapered or canted radially outwardly as it extends axially so as to form a slight angle F (FIG. 1) with respect to the collar axis which angle, in this specific example, is 2°. The collar 14 is formed with an arcuate lip or protrusion 18 that projects radially inwardly from its interior surface 19 and the protrusion 18 is configured and sized to fit within the post groove 12.

A shelf support 20 of generally right triangular shape has three side walls 21, 22 and 23. The juncture of side walls 22 and 23 cut away and is formed with a recess 25 of generally semicylindrical shape. The interior wall 26 of the recess is formed with two slots 27 each positioned adjacent a side wall 22 or 23. Like the flanges 15 of collar 14, the slots 27 also are tapered with respect to the longitudinal axis 28 of the recess 25. The degree of the taper of the slots, however, is slightly less than that of the collar flanges. Thus, in this example, the taper angle is $1\frac{1}{2}°$. The two portions of the recess wall 26 that extend between the slots 27 and recess lips 29, are of slightly greater radii than that portion which bridges the slots. The height, or axial thickness of the shelf support is the same as that of the collar 14.

Figure 4:
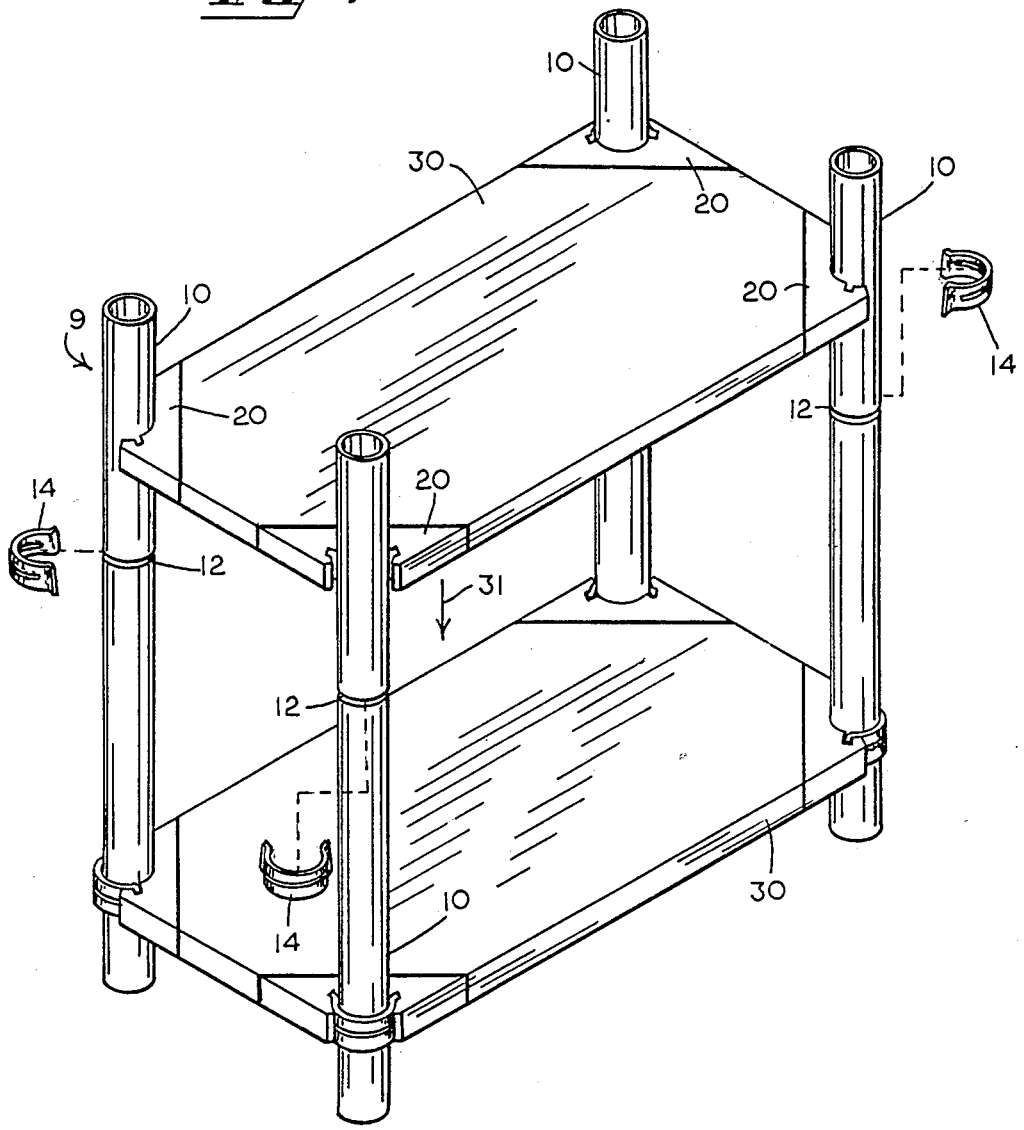
FIG. 4 is a perspective view of the shelving apparatus, showing how the lock collars engage the upright posts and shelves.

In FIG. 1 only a portion of one post 10 has been drawn for purposes of clarity and conciseness of explanation. As illustrated in FIG. 4, a set of posts 10 typically is provided as is a set of collars 14 and supports 20 for each shelf. Here, the support is shown as a corner support for a shelf 30. However, where desired, the support may itself be a complete shelf in which case each of its corners is formed with a recess 25. Though the recess is shown in a corner or juncture of the two walls 22 and 23, it can be formed in a side of a shelf (not shown). The posts have a plurality of annular indentations 12 at spaced intervals along their lengths to accomodate a number of shelves or shelf supports.

As illustrated in FIG. 4, to assemble the shelving apparatus just described collars 14 are placed flushly adjacent a side of the posts 10 with lip 18 of each collar 14 detented in post groove 12. This is done by bringing the collar radially to the post. Next, the supports 20 are brought against the opposite sides of the posts just above the collars with the recess 25 of each support receiving a post. With the recess 25 of each support 20 held flushly against the post, as indicated by arrows 31, the supports are moved downwardly so as to mount the slots 27 of each recess 25 about the flanges 15 of the collars 25. Continued downward movement of the supports causes the collar flanges 15 of the collars 14 to become wedged snuggly against the walls of the recess slots 27 due to the difference in their angles of taper with respect to the coincident axes of the post, collar and support. This is turn causes the collars 14 and supports 20 to become snuggly secured to the post and to each other. Again, it is pointed out that in doing so, both the collar, as well as the support, may have been brought radially to the post. Thus, with this assembly method shelves may be mounted between other shelves without having to remove or relocate such other shelves in the process. It should be noted that the assembly procedure may be easily performed without the use of tools.

As previously stated, the supports 20 can be constructed separately with respect to the shelves 30. With this arrangment, the supports can be mounted first to the posts 10 and the shelf 30 can then be mounted to the supports. If the supports 20 are connected first to the shelves 30, the shelves can be inserted between the posts 10 at an angle and then reoriented to a horizontal altitude before being moved vertically for a wedge fit with respect to the lock collars 14 about the posts 10.

Figure 5:
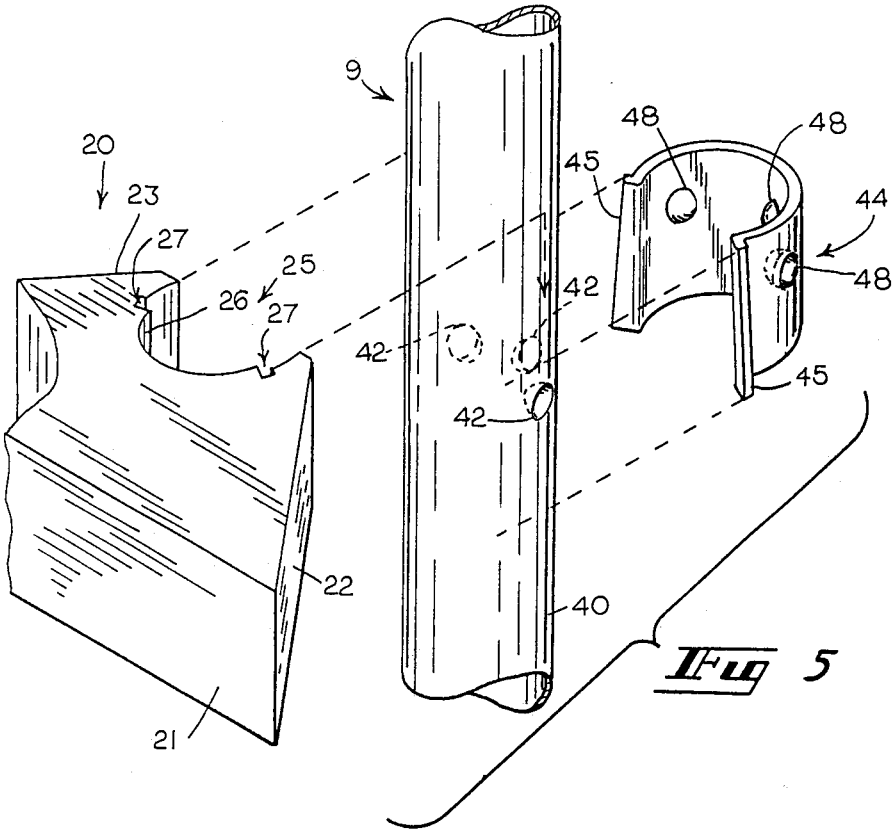
FIG. 5 is an exploded detail perspective view of shelving apparatus, similar to FIG. 1, but illustrating another embodiment of the invention.

As illustrated in FIG. 5, wherein a second embodiment of the invention is disclosed, post 40 includes dimples or indentations 42 at 90° intervals about the longitudinal axis of the post, instead of an annular groove of the type illustrated in FIG. 1. The lock collar 44 is similar to lock collar 14 in FIG. 1, except that a pair of circular protrusions 48 are formed on the inside surface of the lock collar at 90° spacing from the longitudinal axis of the lock collar. Therefore, the protrusions 48 will mate with the dimples 42 of post 40 when the lock collar is brought toward engagement with the post. Also, the dimples 42 and protrusions 48 tend to orient the lock collar in its proper attitude about the post for subsequent engagement of the flanges 45 of the lock collar with the slots 27 of the shelf.

When the lock collar 44 is mounted to post 40 and the shelf is mounted to the lock collar and post, the protrusions 48 will nest with the dimples 42 and will prevent axial movement of the lock collar along the length of the post. This holds the shelf in static relationship with respect to the post 40.

While both embodiments of the invention have been disclosed in connection with a shelving system, it should be understood that shelving systems of the type disclosed herein can be constructed so as to be compatible with the food service industry, particularly in connection with refrigerated storage and dry storage of food goods. Moreover, the system is compatible with designs for storage rooms for offices and warehouses, for decorator items of the type that would be present in offices and homes, and in environments where cleanliness is important such as in hospitals. Moreover, the system is durable and stable enough so as to be used in scaffolding, and in the storage of heavy items in shops, industrial plants, garages, pantries, and various storage environments.

Although the invention has been described in the form of a preferred embodiment, many modifications, additions, and deletions may be made thereto without departure from the spirit and scope of the invention, as set forth in the following claims.

I claim:

1. Shelving apparatus comprising, in combination, a cylindrical post having an indentation formed in an exterior surface thereof; a collar of generally semicylindrical shape having flanges formed along radially opposed side edges thereof and a protrusion formed on the interior surface thereof for detenting engagement with said post indentation with the collar placed flushly to one side said post; and a support having a generally semicylindrical recess formed in a side thereof and a pair of slots formed along radially opposed portions of an interior surface of said recess configured to receive and wedge into gripping engagement said pair of collar flanges as said support recess is slid along the opposite side of said post and into engagement with said collar.

2. Shelving apparatus in accordance with claim 1 wherein said post indentation is in the form of an arcuate slot and wherein said collar protrusion is in the form of an arcuate lip.

3. Shelving apparatus in accordance with claim 1 wherein each of said collar flanges tapers radially outwardly as it extends axially, and where each of said support slots tapers radially outwardly as it extends axially but to a lesser degree than the taper of said collar flanges.

4. Shelving apparatus in accordance with claim 1 and wherein said post indentation is in the form of a concave dimple and wherein said collar protrusion is in the form of a hemispherical protrusion.

5. Shelving apparatus comprising, in combination, un upwardly extending post including a series of indentations spaced from one another along its length, a collar configured to be placed flushly against one side of said post and partially surrounding said post and including two collar guide bars extending outwardly from said opposite sides of said post and tapered away from each other in a downward direction along the length of said post, a protrusion formed on said collar for registering with one of said indentations of the post for fixedly locating said collar axially along said post, and a support having a facing surface configured to be placed flushing against another side of said post, said support being formed with two slots configured to receive and to wedge into gripping engagement with said two collar guide bars as the slots move downwardly along the length of said post with respect to said collar for drawing said collar and support tightly about said post.

6. Shelving apparatus in accordance with claim 5 wherein said post is cylindrical and wherein said collar and the facing surface of said support are each generally semicylindrical.

7. Shelving apparatus in accordance with claim 5 wherein said two collar guide bars and said support recess slots are canted at mutually different cant angles.

* * * * *